United States Patent [19]

Breznock et al.

[11] 4,034,427

[45] July 12, 1977

[54] AEROSOL DRAIN OPENER DEVICE

[75] Inventors: John F. Breznock, Dublin; Richard E. Melrose, Lafayette; Richard N. Miller, Pleasanton, all of Calif.

[73] Assignee: The Clorox Company, Oakland, Calif.

[21] Appl. No.: 652,399

[22] Filed: Jan. 26, 1976 (Under 37 CFR 1.47)

[51] Int. Cl.[2] ..... E03D 11/00

[52] U.S. Cl. ..... 4/255; 4/256; 222/402.13

[58] Field of Search ..... 4/255, 256, 257; 222/402.13; 134/166 C, 167 C, 168 C, 169 C; 251/349, 353

[56] References Cited

U.S. PATENT DOCUMENTS

| | | | |
|---|---|---|---|
| 3,744,678 | 7/1973 | Beres et al. | 222/402.13 |
| 3,792,802 | 2/1974 | Gores | 222/402.13 |
| 3,823,427 | 7/1974 | Pittet | 4/255 |
| 3,841,533 | 10/1974 | Carroll et al. | 222/402.13 |
| 3,935,974 | 2/1976 | Weyn | 222/402.13 |
| 3,935,999 | 2/1976 | Weyn | 222/402.13 |
| 3,936,000 | 2/1976 | Weyn | 222/402.13 |

*Primary Examiner*—Henry K. Artis
*Attorney, Agent, or Firm*—Phillips, Moore, Weissenberger, Lempio & Majestic

[57] ABSTRACT

A hydraulic device utilizes an aerosol can containing propellant for unblocking drains or other types of conduits by use of hydraulic ram pressure. A nozzle having a curved surface is movably mounted on the discharge end of the propellant container and is actuable by means of pressing the nozzle against the conduit opening to discharge a quantity of propellant gas into the conduit. The curved surface of the nozzle conveniently seals against the conduit opening. An annular skirt depending from the nozzle surrounds the upper can chine and an internal annular rib therein retains the nozzle on the container while allowing sufficient travel of the nozzle to move and actuate a valve stem of a valve assembly within the container discharge opening. A disc spring is located intermediate the nozzle and the container end having the discharge opening which normally biases the nozzle away from the valve stem of the valve assembly. Upon compression of the disc spring by pressing the nozzle against the conduit opening, the spring moves in a substantially regressive load deflection curve within a working deflection range until the disc is over centered and the valve stem fully depressed to permit expulsion of propellant gas through a discharge passage including a diffuser portion centrally disposed in the nozzle end. Upon release of the nozzle, the disc spring will cause the nozzle to return to its initial position and propellant flow will be stopped. The disc spring includes a plurality of grooves around the periphery thereof for permitting escape of trapped propellant. Additional diffusers are utilizable with the nozzle to permit sealing against flat surfaces surrounding the conduit opening.

12 Claims, 7 Drawing Figures

18
20
24
26
16
22
54
40
44
42
46
36
34
38
48
48
30
50
52
12
32
28
33
14

18
20
24
26
56
16
40
22
44
54
34
42
46
38
48
48
50
36
30
12
32
28
14
33

AEROSOL DRAIN OPENER DEVICE

BACKGROUND OF THE INVENTION

This invention relates to devices for clearing blocked drains or conduits or the like. More particularly, this invention relates to a device which uses an aerosol propellant container for dispensing a desired amount of gas under pressure into a conduit through a nozzle to produce a clearing of the blockage.

The problem of clearing conduits, such as household drains, of blockages is a constantly reoccurring one. Many methods and devices have been used in the past for attempting to solve this problem. Chemical drain openers are well known in the art as is their principle of chemically attacking blockage material to effect its removal. However, some blockages are not susceptible of such chemical removal, at least not very easily. Furthermore, the chemical removal methods typically take a sufficient period of time to render them other than instantaneous.

Mechanical techniques for removing blockages are quite old. The common plumber's helper, which is basically a simple plunger, operates by creating a pressure buildup in the conduit to effectively remove the blockage from its point of lodgement. More recently, devices have been developed which use stored compressed gas for creating necessary pressure. An example of one such device is that of Caplan et al, U.S. Pat. No. 3,138,803. However, this patent device has a disadvantage in that the compressed gas cartridge found therein is only usable once. A similar device is that shown in Gasser, U.S. Pat. No. 2,939,154. As with the previous device, the cartridge must be replaced after each use. This is both inconvenient and costly.

With the advent of aerosol containers, the possibility of multiple gas discharges has become a reality. For example, Pittet, U.S. Pat. No. 3,823,427, utilizes an aerosol container having a conventional inverted vertical action aerosol valve of reciprocating type by which a liquified gas or propellant within the container may be selectively discharged. The selective discharge of the aerosol gas is accomplished by means of pressing a nozzle against the drain conduit opening, which compresses the helical biasing spring mounting the nozzle to the container. The nozzle, when so compressed, actuates a valve assembly comprising a conventional valve through a valve stem.

However, the force needed to move the nozzle against the biasing force of the spring is proportional to the distance traveled. In this manner, the device is rather stiff and difficult to operate. Further, the working distance traveled is rather large. Another disadvantage is the cost of manufacture and assembly of the spring, which is typically made of metal.

SUMMARY AND OBJECTS OF THE INVENTION

It is therefore the primary purpose of this invention to provide an improved aerosol dispenser device having an improved spring thereon, which has a regressive load/deflection curve and a smaller working deflection range.

It is a further object of this invention to provide such a device having a working deflection range which is desirably narrow.

It is a still further object of this invention to provide such a device which has improved nozzle structure for sealing with conduit openings and the flat surfaces surrounding such openings.

The invention takes the form of an aerosol propellant device for cleaning waste blockages in conduits by use of a hydraulic ram effect. The device includes a standard or conventional aerosol propellant container having an inverted vertical action valve assembly. The valve assembly includes a valve stem controlling a valve which is biased to a closed position by means of a valve spring. A nozzle is movably mounted on the end of the propellant container and is actuable from its normal position to an operative or discharge position by means of pressing the nozzle by means of the container or can against the conduit opening, such as a drain opening. The relative movement of the nozzle with respect to the container allows the discharge of propellant through a passage including a diffuser portion centrally disposed in the nozzle.

The nozzle is normally biased to the valve closed position by means of a disc spring which is located intermediate the nozzle and the end of the propellant container. The disc spring is a generally curved, thin member, having an outer circumference with a plurality of grooves therein for permitting the escape of trapped propellant gas which would otherwise be contained between the container end and the disc spring.

A plurality of finger-like projections depend from the circumference of the disc spring and serve to grip the topmost chine of the propellant container so that the disc spring is retained thereon. An annular projection around a centrally disposed opening of the disc spring mates with a depending cylindrical projection on the underside of the nozzle for transmitting force between the nozzle and disc spring for compression. The disc spring moves from its curved, uncompressed state to an over center position with a substantially flat or regressive load deflection curve in a very small load deflection range.

An annular skirt depending from the nozzle surrounds the container end and an annular rib therein retains the nozzle on the container end, while at the same time permitting free travel of the nozzle in the working range of the disc spring.

Auxiliary diffuser nozzles having generally frustoconical shape are fittable over the end of the nozzle so that the aerosol device may accommodate larger drain openings than may be spanned by the curved nozzle. The walls of the auxiliary diffuser nozzle may be either straight or curved.

Further and other objects and advantages will become more readily apparent from a review of the following disclosure and accompanying drawings.

DETAILED DESCRIPTION

Figure 1:
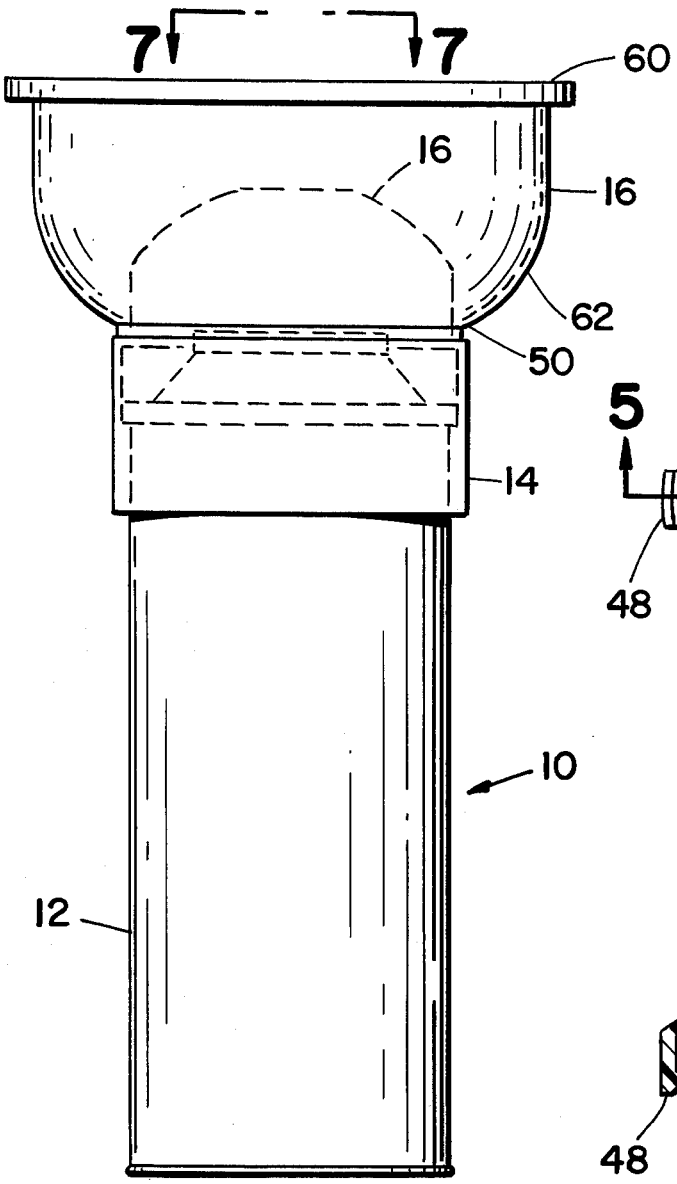
FIG. 1 is an elevation view of the aerosol propellant drain opener device of the instant invention including a curved auxiliary diffuser nozzle mounted on the normal, curved nozzle.

Turning to FIG. 1, there is shown generally at 10 an aerosol propellant for cleaning waste blockages. The device is comprised of a conventional aerosol propellant can or container 12 of generally cylindrical shape having a movable nozzle 14 mounted thereon, as will be more fully described hereinafter. As will also be more fully described hereinafter, an auxiliary diffuser nozzle 16 may be mounted on the nozzle. The propellants are preferably non-flammable and may be one or a combination of non-flammable fluoro-carbon propellants commonly available. Also possible for use within the propellant container are other compressed gasses or blends thereof. Such gasses would be, for example, carbon dioxide, nitric oxide, etc. Typically, the container would be filled with a liquified, non-flammable propellant, having vapor pressures of about 30–70 psi at 70° Fahrenheit.

Figure 2:
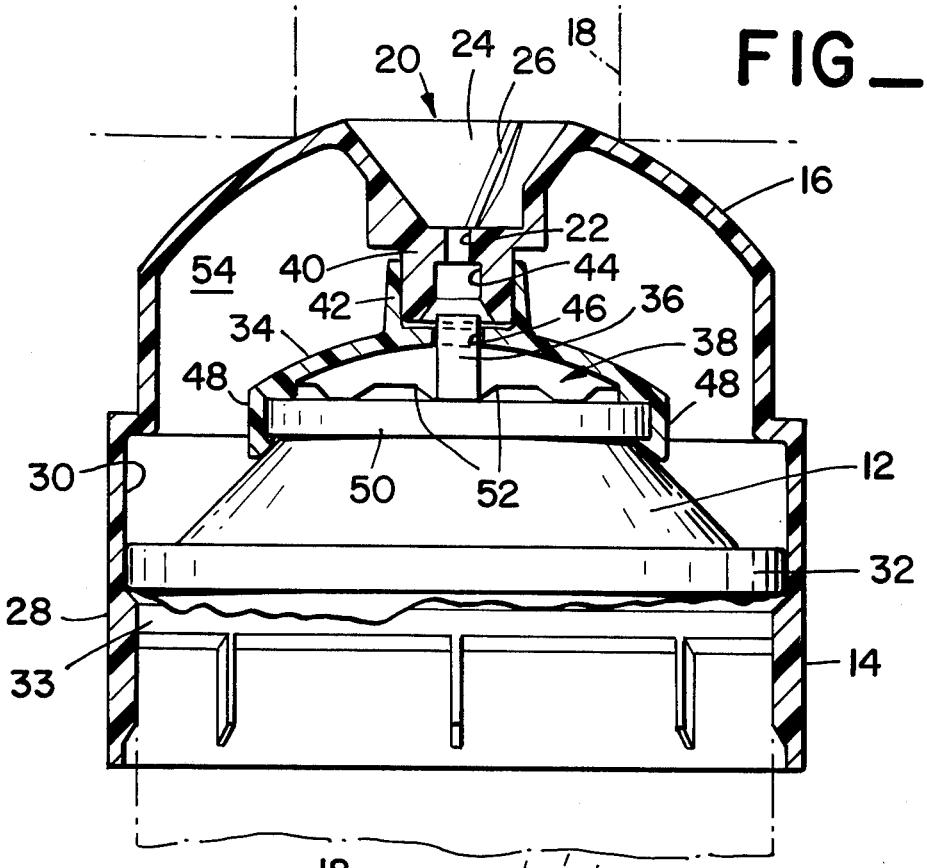
FIG. 2 is an enlarged side elevation view in cross section showing the nozzle in its normal, inoperative position, with the propellant container partially cut away for purposes of clarity.
Figure 3:
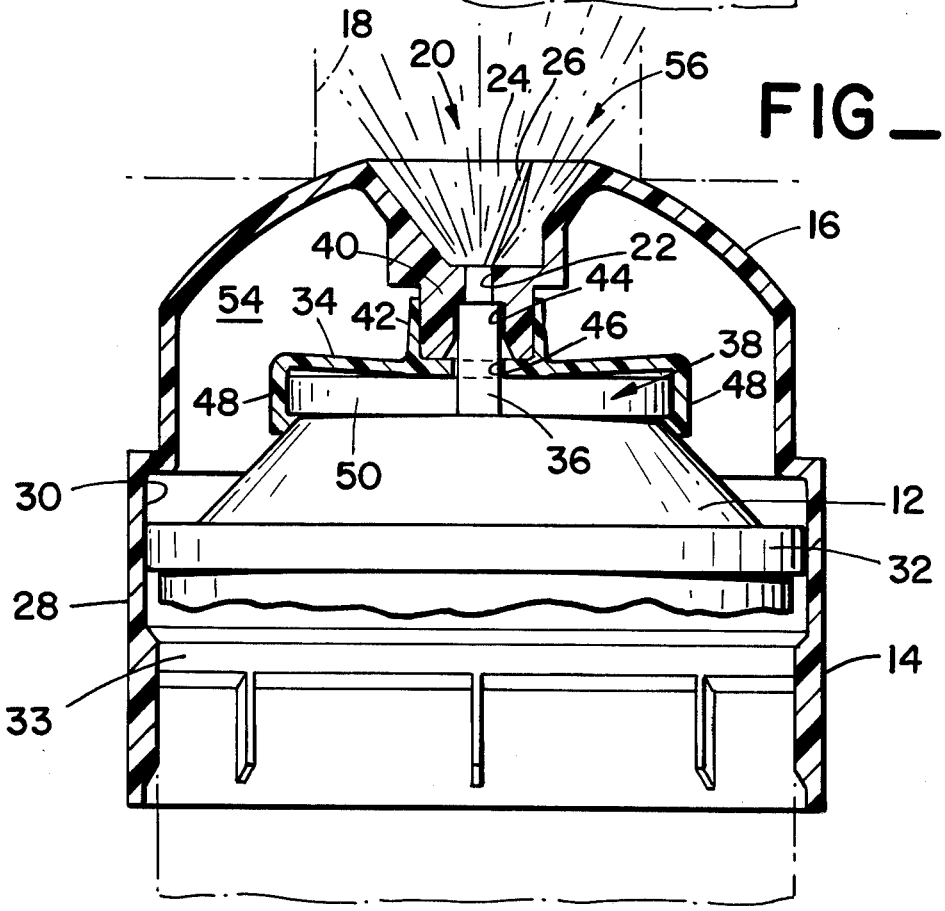
FIG. 3 is a view of the same, showing the nozzle depressed and the propellant container in the operative or discharge position with the disc spring compressed.

Turning to FIGS. 2 and 3, the relationship of nozzle 14 to the discharge end of propellant container 12 is easily seen. The curvature of nozzle 14 allows the sealing accomodation to circular draining openings, such as shown at 18. Due to the curvature, a variable number of drain opening diameters may be accommodated.

Figure 7:
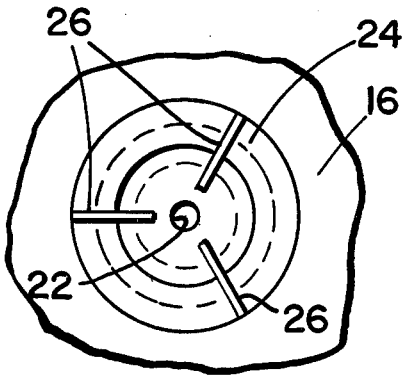
FIG. 7 is a view taken along lines VII—VII in FIG. 1, showing details of the nozzle discharge opening.

Centrally disposed within the nozzle 14 is a discharge opening 20. The discharge opening is comprised of a generally cylindrical straight section 22 leading to a generally frustoconical diffuser portion 24. The diffuser portion 24 has a plurality of grooves 26 therein, as best seen in FIG. 7. These grooves are for the purpose of prohibiting the use of the device to propel objects which may be placed therein by, e.g., small children. The grooves allow the propellant gasses to bypass the small objects and prevent the propulsion thereof from the device.

Returning to FIGS. 2 and 3, the nozzle is seen to further comprise an annular skirt portion 28 which depends therefrom and surrounds the discharge end of propellant container 12. The interior diameter 30 of the skirt portion closely accommodates the annular can end chine 32. An annular rib 33 within the skirt serves to limit motion of the nozzle, as will be more fully described hereinafter. Intermediate the nozzle 14 and the can 12 is a disc spring 34, the purpose of which is to bias the nozzle out of engagement with valve stem 36 of valve assembly 38 of the propellant container. As seen, a cylindrical projection 40 depending from the underside of nozzle 14 is fitted within a raised annulus 42 on disc 34. A cylindrical recess 44 within projection 40 accommodates the end of valve stem 36, which is extended through a centrally disposed opening 46 in disc 34.

Figure 4:
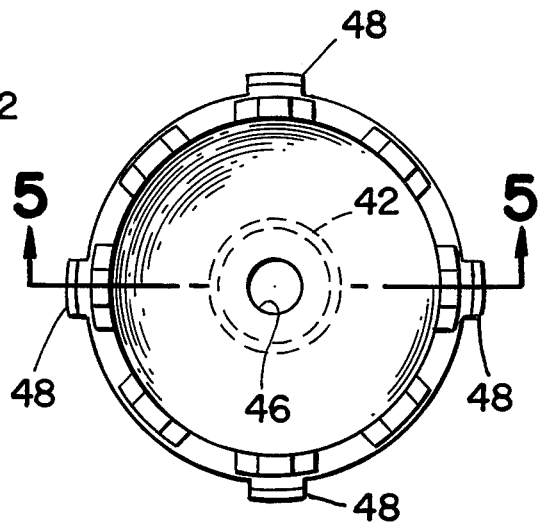
FIG. 4 is a top plan view of the disc spring.
Figure 5:
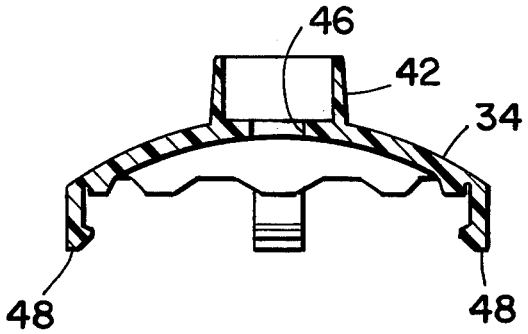
FIG. 5 is a view taken along lines V—V in FIG. 4.

As seen in FIGS. 4 and 5, disc 34 has a plurality of projections 48 depending from the circular periphery thereof. Projections 48 serve to grip the topmost can chine 50, as best seen in FIG. 2. In this manner, the disc is retained on the propellant container. As also seen in this figure, a plurality of grooves 52 are also contained around the periphery. These grooves serve to allow discharge of any trapped propellant gas which may accumulate between the disc and the container end to be dissipated into the nozzle interior chamber 54 and thence around can chine 32 to the surrounds.

The material of the disc may conveniently be plastic material. One plastic that is particularly satisfactory is Lexan polycarbonate. The disc spring thus produced has a virtually constant force for a large portion of the stroke of the spring. In other words, the spring produces a regressive or flat load/deflection curve and a working deflection range which is quite small. The prior art working deflection range is about ⅜ to ½ inches using a metal helical spring. With the instant invention, the working range is reduced to approximately ⅛ inch. The curved shape of the disc is spherical.

With particular reference to FIG. 3, the device is shown in the discharge position, wherein the propellant 56 is shown exiting from the diffuser 24. The disc spring is shown in an over center position, where it has passed the flat portion and is now dished downwards. Upon releasing the pressure of the can against the nozzle 14, the disc spring 34 will cause the nozzle to again position itself in the initial position shown in FIG. 2 and propellant will cease to be discharged. Thus, a number of applications of propellant can be accomplished with a single aerosol propellant container.

Figure 6:
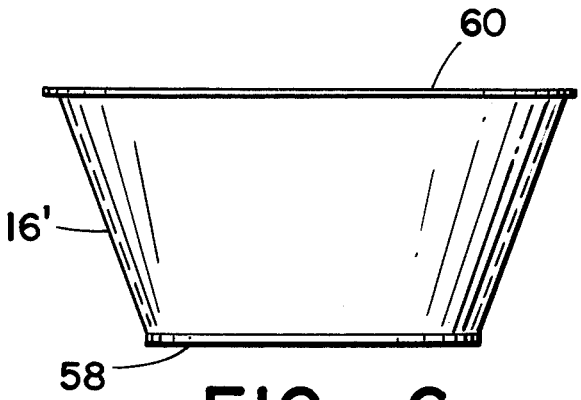
FIG. 6 is a side elevation view of a second diffuser nozzle.

Turning to FIG. 6, there is shown an auxiliary nozzle or diffuser 16′ having a smaller diameter end 58′ which may be conveniently fitted over the normal, curved nozzle. A larger diameter end 60 is suitable for sealing against a flat surface around the drain opening, such as a sink surface. In this manner, larger openings that cannot be accommodated by the curved nozzle can be accomodated with the larger diameter end. As shown in FIG. 1, rather than being straight, the sides of the diffuser may be curved, as shown at 62.

It is to be understood that the foregoing description is merely illustrative of a preferred embodiment of the invention, and that the scope of the invention is not to be limited thereto, but is to be determined by the scope of the appended claims.

What is claimed is:

1. In an aerosol propellant device for cleaning waste blockages in conduits by a hydraulic ram effect, said device comprising an aerosol, propellant containing container having an inverted vertical action valve assembly including a valve stem controlling a valve for delivery of propellant from said container, means biasing said valve stem to the closed position wherein no propellant is discharged, a nozzle movably mounted on said container for selective movement to actuate said valve by movement of said valve stem in opposition to said means biasing said valve stem, and spring means intermediate said nozzle and said container for biasing said nozzle in the direction of said means biasing said valve stem, and wherein said spring means comprises a curved disc spring defining an outer circumference for abutting said container, said disc spring further having a substantially regressive load/deflection curve in a working deflection range.

2. The invention of claim 1 wherein said nozzle has means thereon for sealingly engaging an opening of said conduit.

3. The invention of claim 2 wherein said means for sealingly engaging said conduit comprises a curved surface on said nozzle.

4. The invention of claim 1 further including a diffuser means on said nozzle for diffusing propellant discharged therethrough.

5. The invention of claim 4 wherein said diffuser means comprises a generally frustoconical, hollow body having smaller and larger diameter ends with openings therein, said small diameter end being fitted on said nozzle, and said large diameter end being adapted for sealing against a surface surrounding said conduit opening.

6. The invention of claim 5 wherein said body defines curved sidewalls intermediate said smaller and larger diameter openings.

7. The invention of claim 1 wherein said nozzle has a centrally disposed passage therethrough including a generally cylindrical portion leading into a generally frustoconical diffuser portion.

8. The invention of claim 7 further including at least one groove in said diffuser portion.

9. The invention of claim 1 further including at least one groove in said outer circumference to permit the escape of trapped propellant.

10. The invention of claim 9 further including a plurality of projection means extending from said outer circumference for gripping said container, whereby said disc spring is retained on said container.

11. The invention of claim 1 wherein said nozzle comprises a generally hollow body having a centrally disposed discharge passage therein and a generally cylindrical projection surrounding said discharge passage, said disc spring including a centrally disposed, raised annulus thereon closely surrounding said generally cylindrical projection.

12. The invention of claim 11 wherein said container includes a generally circular chime defining a first diameter therearound, said nozzle further including an annular skirt defining a second interior diameter greater than said first diameter surface, and further including an interior annular rib on said interior diameter surface of a third diameter less than said first diameter, whereby said nozzle is retained on said container while allowing movement thereof to actuate said valve assembly.

* * * * *